US005338256A

United States Patent [19]

Tonna

[11] Patent Number: 5,338,256

[45] Date of Patent: Aug. 16, 1994

[54] VENTILATOR

[76] Inventor: Anthony Tonna, 122 Phoenix Street, North Sunshine, Victoria 3020, Australia

[21] Appl. No.: 997,099

[22] Filed: Dec. 29, 1992

[30] Foreign Application Priority Data

Dec. 31, 1991 [AU] Australia ..... PL 0230

[51] Int. Cl.[5] ..... F24F 13/06

[52] U.S. Cl. ..... 454/310; 454/300; 454/331

[58] Field of Search ..... 454/292, 299, 300, 309, 454/310, 330, 331, 332, 316, 284, 289

[56] References Cited

U.S. PATENT DOCUMENTS 2,153,576 4/1939 Kurth et al. ..... 454/310 X
2,603,141 7/1952 Phillips et al. ..... 454/310
5,117,745 6/1992 Prochnow et al. ..... 454/300

*Primary Examiner*—Harold Joyce
*Attorney, Agent, or Firm*—Davis, Bujold & Streck

[57] ABSTRACT

A ventilator for ceilings, walls or floors comprises two principal integers, an outlet means and a ventilation tube connector. These integers may be connected by screw-thread means which is operable from outside the ventilator either manually or by means of a special tool.

8 Claims, 3 Drawing Sheets

VENTILATOR

FIELD OF THE INVENTION

This invention relates to a ventilator for use in passing cool or warm air to a room.

BACKGROUND OF THE INVENTION

Air may be passed into a room through floor or ceiling ventilators or, less usually, through wall ventilators.

One particular problem with which the present invention is concerned is the placement and fixing of ventilators such as ceiling ventilators. Thus one type is known which makes use of spring-loaded catches connected to inner locations on such a ceiling ventilator. A suitably sized and shaped hole may be cut in the ceiling and a ventilator of this type inserted through the hole. The catches may then be tripped so that they grip the ceiling holding the ventilator in place. Such catches may not have sufficient strength to hold a heavy ventilator in position.

The object of the present invention is to overcome the problem outlined above and provide a ventilator which can be inserted, positioned and fastened from below the ceiling or outside the wall or above the floor.

BRIEF SUMMARY OF THE INVENTION

A ventilator for ceilings, walls or floors which comprises an outlet means and a ventilation tube connector, wherein the ventilation tube connector is adapted to bear against an internal surface of a ceiling, wall or floor, the outlet means being adapted to bear against the corresponding external surface of the ceiling, wall or floor and wherein the outlet means and the ventilation tube connector are connectable by screw-thread means and wherein the screw-thread means may be adjusted by insertion of a hand or a suitable tool through the outlet means, whereby the outlet means and the ventilation tube connector may be drawn towards each other fixing the ventilator to the periphery of a hole cut in the ceiling, wall or floor.

BRIEF DESCRIPTION OF THE DRAWINGS

The drawings show two examples of ventilators, which are particularly suitable for ceilings, according to the invention. Thus.

DETAILED DESCRIPTION OF THE INVENTION

In one embodiment of the ventilator according to the invention, the outlet means is integral with the screw-thread means.

In a second embodiment of the ventilator according to the invention, the outlet means and the screw-thread means are separate.

In a preferred construction of a ventilator according to the invention, deflector vanes are positioned across the outlet to deflect cool or warm air in the desired directions. Since a feature of the invention is the provision of screw-thread means to connect the outlet means and the ventilation tube connector, it is desirable that the vanes be removable or at least capable of being moved aside so that the installer of such devices may reach into the ventilator to rotate the screw-thread means.

The deflector vanes may be housed in a separable unit which may be connectable to the ventilator by a bayonet fitting or a screw-thread. Alternatively part only of the vanes may be removable, the remainder of the vanes being attached permanently to the ventilator. These constructions are particularly suitable for a circular embodiment of the ventilator.

Turning to a rectangular embodiment of the ventilator, the vanes may be removable one by one from the ventilator, shiftable to one side along rails attached to the ventilator or shiftable in a body to one side of the ventilator to allow access to the inside of the ventilator.

The screw thread means may be operated either manually or by means of a special tool adapted to grip the screw thread means internally.

Turning now to the FIGS. 1 to 7, numeral 10 indicates a ventilator set in a ceiling 11. Numeral 12 indicates a vane housing in which are positioned four sets of curved vanes 13, 13A and 14, 14A. A central deflector 15 is connected to the four sets of vanes.

Figure 2:
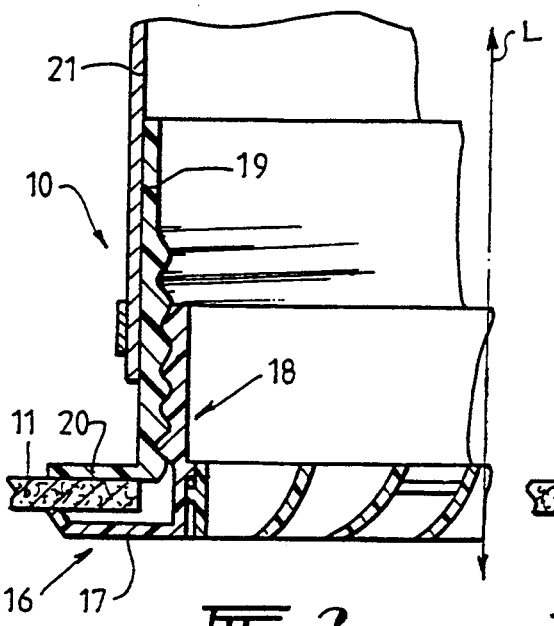
FIG. 2 is a vertical cross-section taken along line 2—2 of FIG. 1 with the longitudinal axis of the ventilator indicated by a L.
Figure 3:
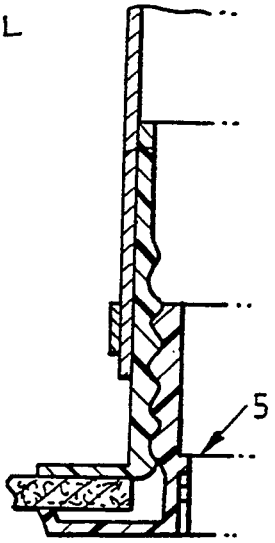
FIG. 3 is another view of the cross-section shown in FIG. 2, with part of the device removed.
Figure 4:
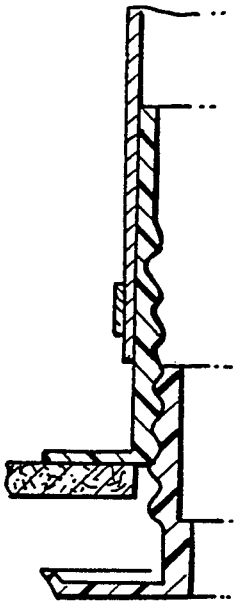
FIG. 4 is a repeat view of the cross-section shown in FIG. 3 with the two major portions separated.

In FIG. 2, an outlet means 16 comprises a circumferential, outwardly directed lower flange 17 and an upstanding portion 18 with an outer thread. This upstanding portion 18 is threaded to a ventilation tube connector 19 having an inner thread. Ventilation tube connector 19 also has a circumferential, outwardly directed upper flange 20 which acts to clamp ceiling 11 between itself and circumferential lower flange 17. A ventilation tube 21 is fitted over ventilation tube connector 19.

Figure 5:
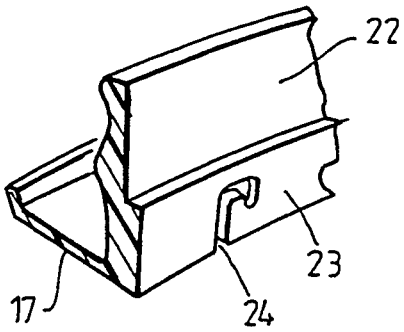
FIG. 5 is a detail of the ventilator as indicated by numeral 5 in FIG. 3.

Referring to FIG. 5, on the inner side of circumferential flange 17 is the lower part of upstanding portion 18 having upper rim portion 22 and lower rim portion 23. Let into lower rim portion 23 is a bayonet fitting slot 24.

Figure 6:
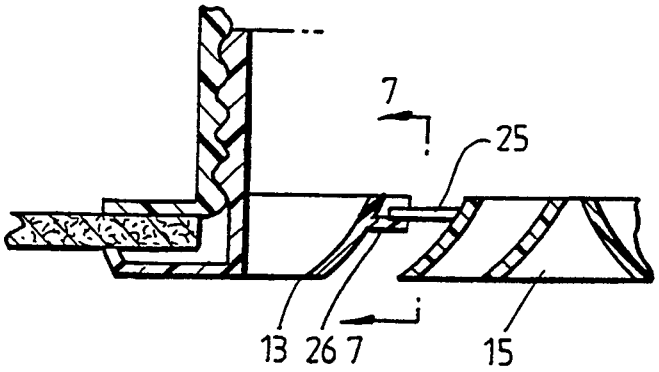
FIG. 6 is a cross-section of the lower portion of the circular ventilator of FIGS. 1 and 2 showing the configuration of air deflector vanes.
Figure 7:
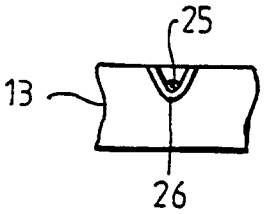
FIG. 7 is a detail of a vane mounting system taken along line 7—7 in FIG. 6.

With reference to FIGS. 6 and 7, central deflector 15 is supported by vanes sets 13, 13A, 14 and 14A by means of a set of four pins 25 and four short channel portions 26 in all on the north, south, east and west sides of deflector 15.

Figure 8:
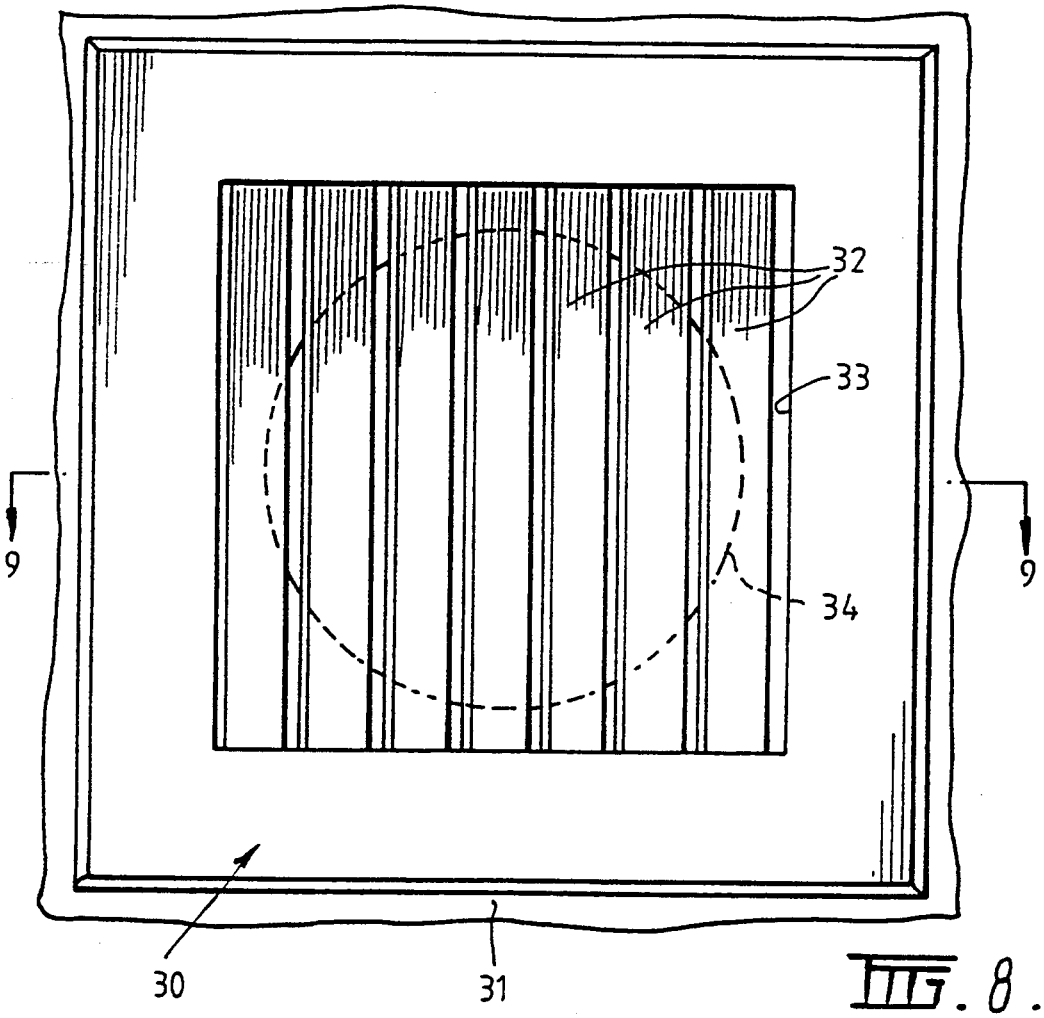
FIG. 8 is a view from underneath of a square ventilator.
Figure 9:
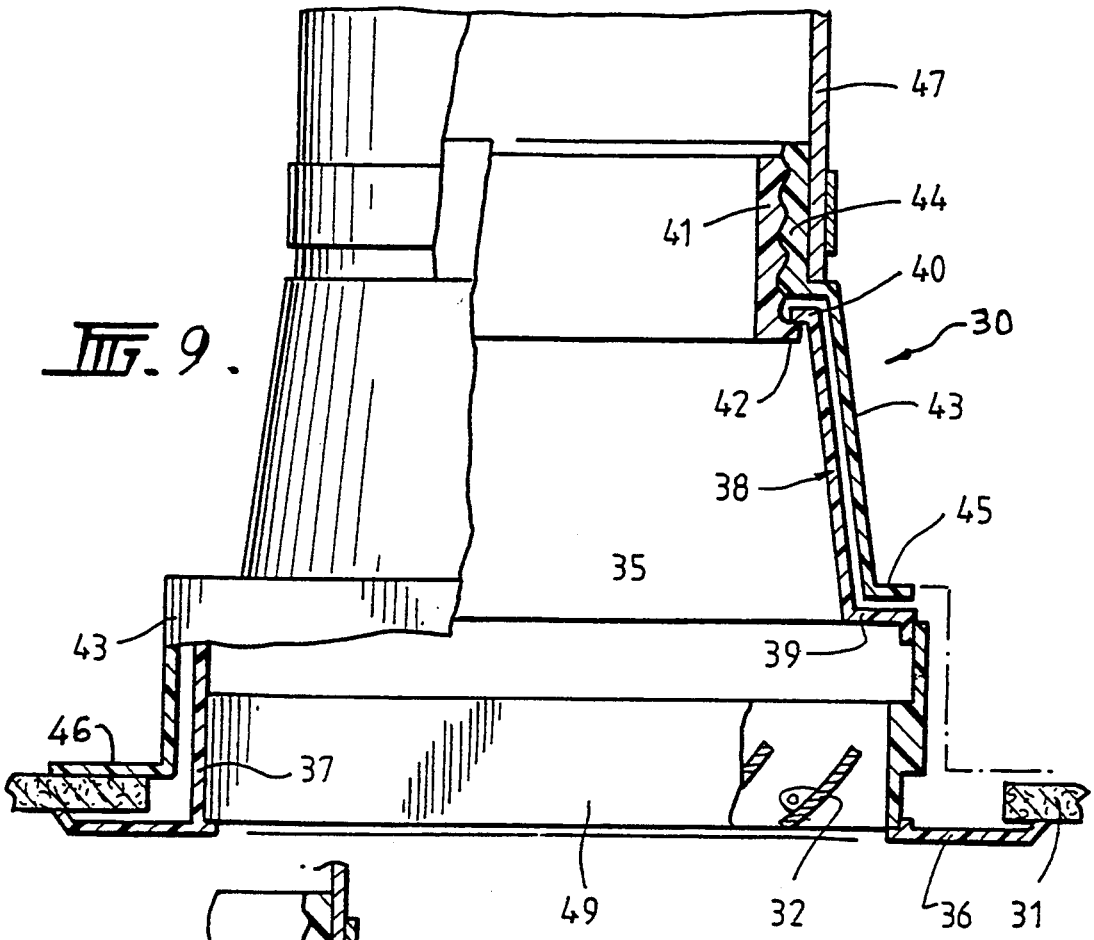
FIG. 9 is a view from the side of a partial cross-section of the ventilator of FIG. 8.
Figure 10:
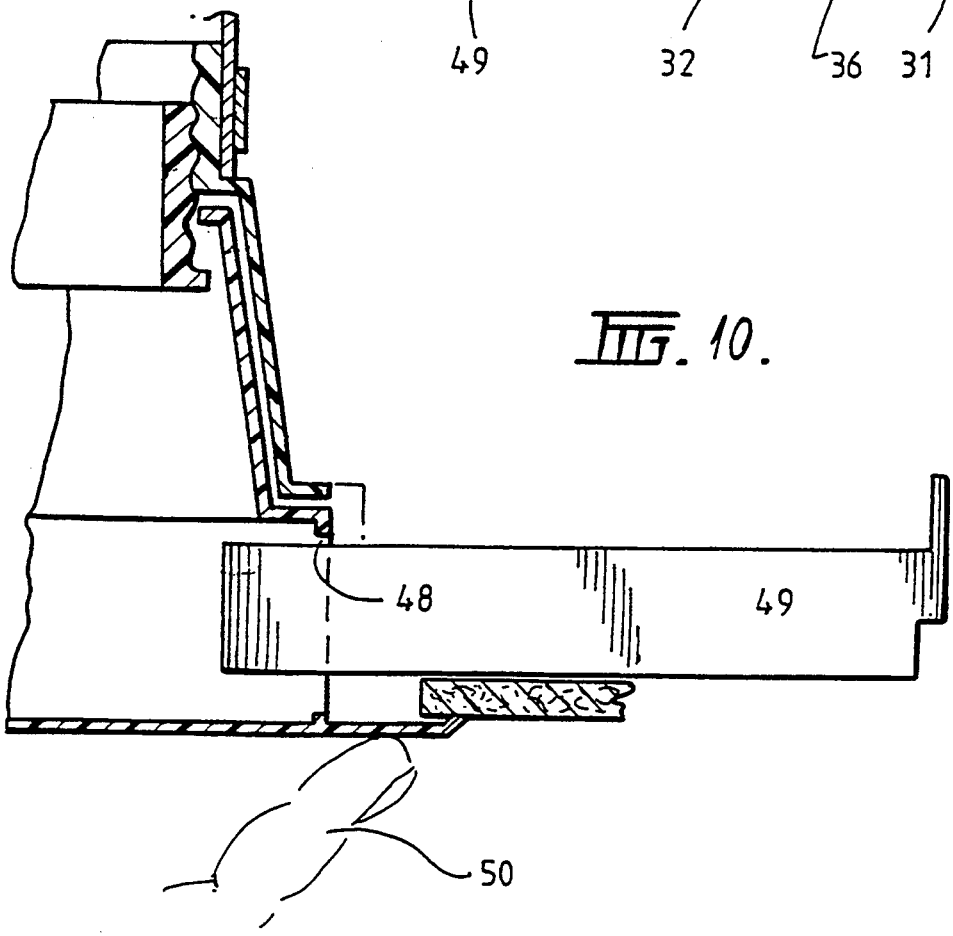
FIG. 10 is a view from the side in partial cross-section of the lower portion of the ventilator of FIG. 8 with that portion which holds the vanes slid to one side.

Turning now to FIGS. 8 to 10, which illustrate a square version of the ventilator, a ventilator 30 is set into ceiling 31. A set of straight vanes 32 is positioned across square outlet hole 33. Dotted circular line 34 indicates the throat of a ventilator tube.

Figure 1:
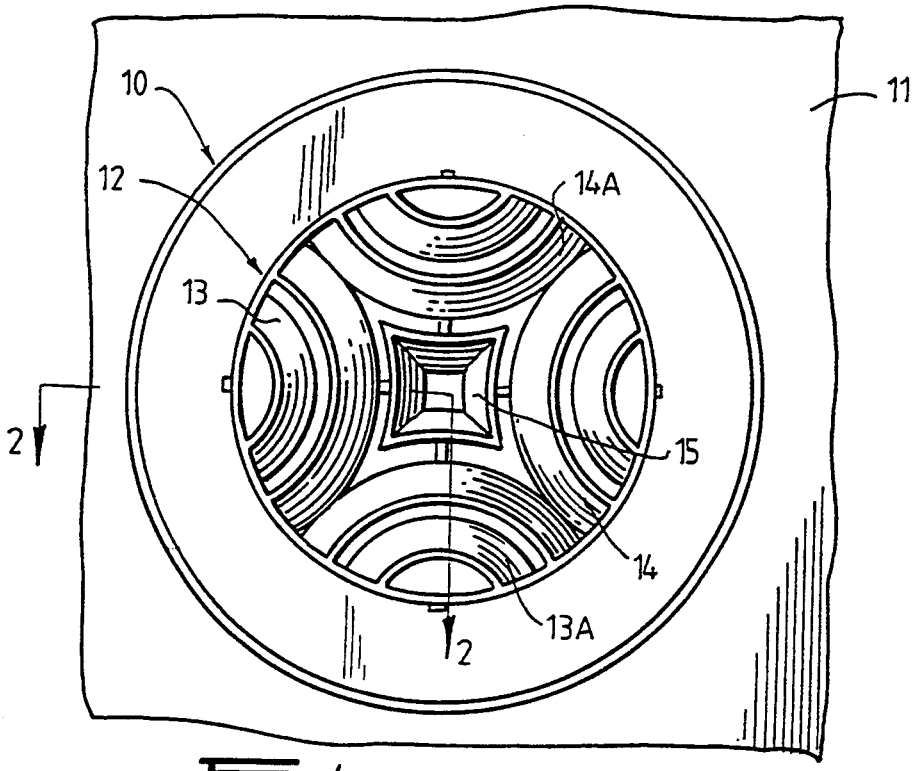
FIG. 1 is a view from underneath of a circular ventilator.

In an alternative embodiment, the shape and construction of the vanes may be similar to that shown in FIG. 1.

In FIGS. 9 and 10, an outlet means 35 comprises an outwardly directed lower flange 36 and an upstanding portion 37. Located inside and above upstanding portion 37 is a connecting means 38 which has a circular cross-section of diminishing diameter, a square outwardly directed lower flange 39 and a circular inwardly directed upper flange 40. Lower flange 39 fits within upstanding portion 37 and upper flange 40 to circular collar 41, which has an outer thread. An outwardly directed lower flange 42 on collar 41 fits under inner upper flange 40 of connector means 38.

Outer skirt means 43 has an upper portion 44, which has an inner thread. Skirt means 43 is circular in cross-section in the region of connector means 38 and is square in cross-section in the region of outlet means 35. Skirt means 43 terminates in an outwardly directed upper flange 45 on one side of the square outlet means and in an outwardly directed lower flange 46 on the three other sides of the square outlet means.

A ventilation tube 47 is fitted over upper portion 44 of skirt means 43.

In FIG. 10, an opening 48 is shown in the lower part of the ventilator on the right hand side of the outlet means as shown in the drawing. A tray 49, which houses vanes 32, may be slid outwards, to the right as shown in the drawing. Part of a hand 50 is shown as holding the ventilator in position against the ceiling while the other hand of the installer may rotate collar 41 to detach it from or attach it to upper portion 44 of outer skirt means 43.

As may be seen by reference to the drawings a hand, or a suitable tool, may be inserted into either the embodiment of FIGS. 1 to 7 or the embodiment of FIGS. 8 to 10 to disengage the threaded components or, alternatively, screw them together clamping the respective ventilator to the ceiling, wall or floor. This is made possible by the ease of removal, in part or in whole of the air deflector vanes from the respective outlet means. Thus, if the shape and construction of the vanes is similar to that shown in FIG. 1, the central portion may be removable so that there is no need for the mechanism of tray 49.

We claim:

1. A ventilator, for a hole in one of a ceiling, a wall, or a floor, comprising:

an outlet member defining a longitudinal axis with an opening extending completely through said outlet member along said longitudinal axis, said outlet member having a radially outwardly extending peripheral flange, adjacent a first end of said outlet member, for bearing against an external peripheral surface of a said hole;

a ventilation tube connector defining a longitudinal axis with an opening extending completely through said ventilation tube connector, said ventilation tube connector having a radially outwardly extending peripheral flange, adjacent a first end of said ventilation tube connector, for bearing against an internal peripheral surface of a said hole; said ventilation tube connector being sized for releasably receiving a portion of said outlet member within said ventilation tube connector's opening;

said outlet member and said ventilation tube connector each having a second end supporting one portion of a mating screw thread means, and said outlet member and said ventilation tube connector being releasably connectable with one another by said mating screw thread means and, when said mating screw thread means is threadingly engaged, said flanges clamping a periphery of a said hole therebetween for securing said ventilator in place; and said outlet member containing a releasable deflector vane member for at least partially obstructing said opening in said outlet member and channeling a fluid, at least a portion of said releasable deflector vane member is at least partially removable from said opening to provide unobstructed access to said screw thread means whereby, once said releasable deflector vane member is at least partially removed, said opening in said outlet member is completely unobstructed so that said screw thread means may be directly adjusted by insertion of one of a hand or a tool through said opening in said outlet member.

2. A ventilator as claimed in claim 1, wherein an interior surface of said opening in said outlet member is provided with a plurality of slots and said releasable deflector vane member is provided with a plurality of projecting pins for releasably engaging said plurality of slots.

3. A ventilator as claimed in claim 1, wherein a slidable tray supports said deflector vane member and said tray is slidable, via slide means, to provide access to the opening of said outlet member.

4. A ventilator s claimed in claim 1, wherein said deflector vane member comprise a plurality of radially outer vanes and a central deflector, and said central deflector is removable separately from said plurality of radially outer vanes.

5. A ventilator, for a hole in one of a ceiling, a wall, or a floor, comprising:

an outlet member defining a longitudinal axis with an opening extending completely through said outlet member along said longitudinal axis, said outlet member having a radially outwardly extending peripheral flange, adjacent a first end of said outlet member, for bearing against an external peripheral surface of a said hole;

a ventilation tube connector defining a longitudinal axis with an opening extending completely through said ventilation tube connector, said ventilation tube connector having a radially outwardly extending peripheral flange, adjacent a first end of said ventilation tube connector, for bearing against an internal peripheral surface of a said hole; said ventilation tube connector being sized for releasably receiving a portion of said outlet member within said ventilation tube connector's opening;

said outlet member and said ventilation tube connector each having a second end with said second end of said ventilation tube supporting first mating screw thread means, said second end of said outlet member having a second mating screw thread means associated therewith, and said outlet member and said ventilation tube connector being releasably connectable with one another by said mating screw thread means and, when said mating screw thread means is threadingly engaged, said flanges clamping a periphery of a said hole therebetween for securing said ventilator in place; and said outlet member containing a releasable deflector vane member for at least partially obstructing said opening in said outlet member and channeling a fluid, at least a portion of said releasable deflector vane member is at least partially removable from said opening to provide unobstructed access to said screw thread means whereby, once said releasable deflector vane member is at least partially removed, said opening in said outlet member is completely unobstructed so that said mating screw thread means may be directly adjusted by insertion of one of a hand or a tool through said opening in said outlet member;

said first end of said ventilation tube connector has a rectangular transverse cross-section and a portion of said ventilation tube connector, adjacent said second end thereof, has a circular transverse cross-section for connection to a cylindrical portion of a ventilation tube, and a rectangular transverse cross-section to a circular transverse cross-section transition is located between said first and second ends of said ventilation tube connector;

said first end of said outlet member has a rectangular transverse cross-section sized to be insertable into said rectangular transverse cross-section of said ventilation tube connector, and a portion of said outlet member, adjacent said second end thereof, has a circular transverse cross-section for connection to an inner portion of the cylindrical portion of said ventilation tube connector, and a rectangular transverse cross-section to a circular transverse cross-section transition is located between said first and second ends of said outlet member; and at least a portion of said mating screw thread means being located adjacent said cylindrical portions of said ventilation tube connector and said outlet member.

6. A ventilator as claimed in claim 5, wherein said mating screw thread means comprises:

a radially inwardly extending flange on said cylindrical portion of said outlet member, adjacent said second end thereof;

an interior thread provided on an interior surface of said circular transverse cross-section of said ventilation tube connector; and a cylindrical collar provided with an exterior thread for engaging said interior thread of said ventilation tube connector, and said cylindrical collar supporting a radially outwardly extending flange for engaging said radially inwardly extending flange of said outlet member.

7. A ventilator as claimed in claim 6, wherein a slidable tray supports said deflector vane member and said tray is slidable, via slide means, to provide access to the opening of said outlet member.

8. A ventilator as claimed in claim 6, wherein said deflector vane member comprise a plurality of radially outer vanes and a central deflector, and said central deflector is removable separately from said plurality of radially outer vanes.

* * * * *